United States Patent [19]

Arabian et al.

[11] Patent Number: 4,718,588

[45] Date of Patent: Jan. 12, 1988

[54] METHOD OF, AND APPARATUS FOR, RETRACTING THE LOOPS AND ENDS OF TOWELS INTO A TEXTILE TOWEL DISPENSER

[75] Inventors: Sandro Arabian, Vaduz, Liechtenstein; Manfred Baumann, Diepoldsau, Switzerland

[73] Assignee: CWS AG, Baar, Switzerland

[21] Appl. No.: 828,982

[22] Filed: Feb. 13, 1986

Related U.S. Application Data

[62] Division of Ser. No. 621,866, Jun. 18, 1984, abandoned.

[30] Foreign Application Priority Data

Jun. 24, 1983 [CH] Switzerland ..... 3451/83

[51] Int. Cl.[4] ..... A47K 10/28; B65H 20/00

[52] U.S. Cl. ..... 226/127; 226/131; 242/55.53; 312/38

[58] Field of Search ..... 226/127, 128, 129, 130, 226/131, 133; 242/55.53; 312/37, 38, 39, 40, 41

[56] References Cited

U.S. PATENT DOCUMENTS

| | | | |
|---|---|---|---|
| 1,693,905 | 12/1928 | Leveille | 226/131 X |
| 1,761,071 | 6/1930 | Crowson | 226/130 X |
| 1,790,182 | 1/1931 | Trinks | 226/129 X |
| 1,922,837 | 8/1933 | Birr et al. | 226/130 X |
| 1,936,690 | 11/1933 | Schwartz | 226/130 X |
| 2,135,767 | 11/1938 | Price et al. | 226/131 X |
| 2,183,252 | 12/1939 | Birr | 226/131 |
| 2,274,155 | 2/1942 | Mustee | 226/131 X |
| 2,592,786 | 4/1952 | Birr | 226/131 X |
| 2,772,937 | 12/1956 | Tansley | 226/131 X |

FOREIGN PATENT DOCUMENTS

| | | | |
|---|---|---|---|
| 588038 | 1/1959 | Italy | 226/131 |
| 491635 | 7/1970 | Switzerland . | |
| 493247 | 10/1970 | Switzerland . | |

*Primary Examiner*—Timothy F. Simone
*Assistant Examiner*—Scott J. Haugland

[57] ABSTRACT

In known textile towel dispensers the clean towel is manually pulled out at the front, the used towel is automatically drawn in at the rear, and the end of the towel hangs down vertically when the roll of clean toweling has been used up. The inventive towel retracting or retraction apparatus contains a towel loop loaded with a weighted roller and concealed by a cover which can be part of an enclosure. The used toweling or towel section is thereby pulled behind the cover where it can neither be seen nor reached by the user. A delay mechanism ensures that the towel loop, which is partially pulled out from the towel dispenser and partially pulled out from behind the cover, remains stationary for a few seconds before it is retracted behind the cover.

7 Claims, 15 Drawing Figures

FIG.7
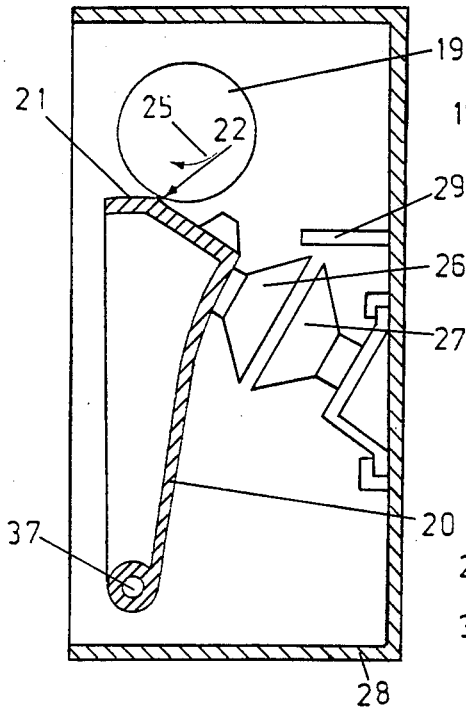
FIG.8
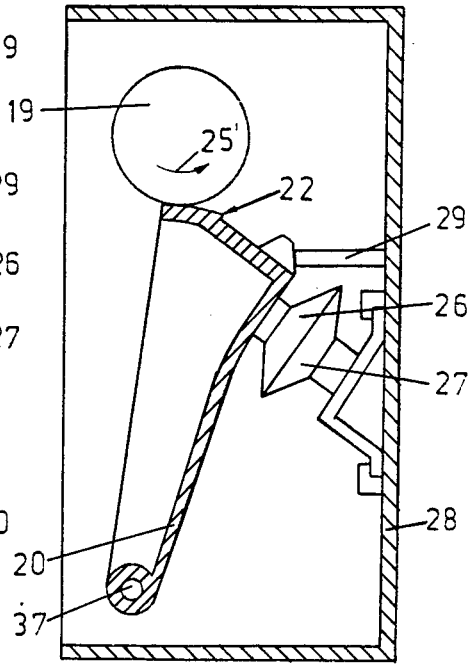
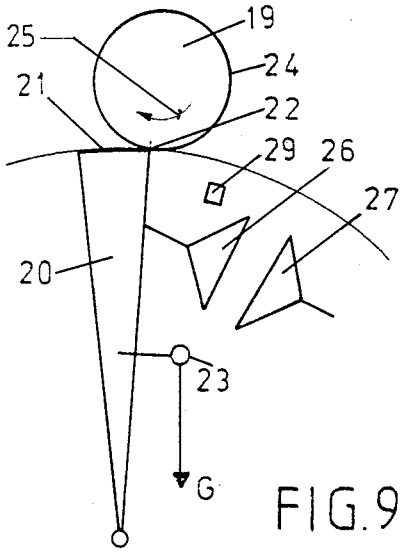
FIG.9
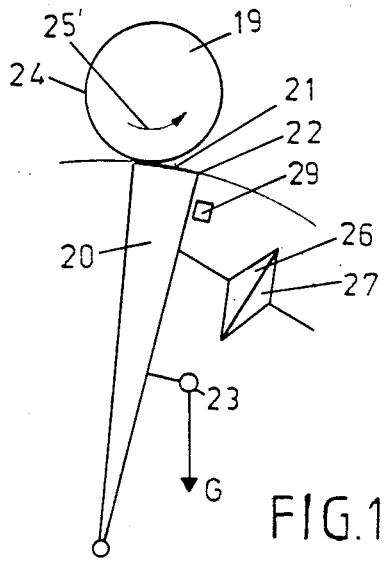
FIG.10

METHOD OF, AND APPARATUS FOR, RETRACTING THE LOOPS AND ENDS OF TOWELS INTO A TEXTILE TOWEL DISPENSER

CROSS REFERENCE TO RELATED APPLICATION

This application is a divisional application of commonly assigned, co-pending U.S. application Ser. No. 621,866, filed June 18, 1984, entitled: "METHOD OF, AND APPARATUS FOR, RETRACTING THE LOOPS AND ENDS OF TOWELS INTO A TEXTILE TOWEL DISPENSER", now abandoned.

BACKGROUND OF THE INVENTION

The present invention relates to a new and improved construction of an apparatus for retracting towel loops and an end of a textile or cloth towel into a textile towel dispenser, especially a hand towel dispenser.

Constructions of known towel dispensers are exemplified by Swiss Pat. No. 491,635, granted June 15, 1970, and Swiss Pat. No. 493,247, granted July 15, 1970.

In known textile hand towel dispensers a loop formed by a portion of an elongated towel web or section hangs out from the towel dispenser and the user's hands can be dried thereat. When the towel loop is pulled out at the front of the towel dispenser, a predetermined length of clean towel comes out of the towel dispenser and, at the same time, an equal length of the towel, usually a dirty towel length, is drawn up into the back of the dispenser, keeping the towel loop at the same length.

The following operations occur inside the towel dispenser during the aforementioned operation of advancing the towel: the length of toweling or towel section which is pulled out at the front of the towel dispenser unrolls from a roll of clean toweling and simultaneously turns another roll by means of various rollers and gears upon which the used toweling is wound up.

Hygienically speaking, such towel dispenser system has one distinct disadvantage which occurs after the towel roll of clean toweling has been used up: the end of the roll which is pulled out at the front of the towel dispenser hangs down when it is released, sometimes even reaching the floor. This dangling towel end, as has been found in practice, continues to be used by people to dry their hands. The concept of a "single use" towel dispenser is thus down-graded to a towel rack for a so-to-speak "common hand towel".

The realization that this cloth towel dispensing system, introduced on a world-wide basis many decades ago, has certain hygienic deficiencies, has in the course of the last few years led to the development of motorized towel dispensers. In these powered models the towel is drawn into or under the towel dispenser by a motor, so that not only the soiled region of the towel resulting from the last hand-drying use is no longer visible, but the towel end hanging out after the roll of clean toweling has been used up also completely disappears inside the towel dispenser.

The disadvantage which all known towel dispensers working with motorized retraction of the towel have in common is, firstly, that the existing towel dispenser must be completely replaced by a new one when it is converted from a non-motorized to a motorized system and, secondly, the motorized-retraction adds considerable expense to the towel dispenser and requires a source of external energy.

SUMMARY OF THE INVENTION

Therefore, with the foregoing in mind it is a primary object of the present invention to provide a new and improved construction of an apparatus for retracting towel loops or sections as well as an end of a towel into a towel dispenser, wherein the towel retracting operation is greatly simplified and no external energy is required for the operation of the towel retracting apparatus.

Another object of the present invention is directed to a new and improved construction of an apparatus for retracting towel loops and an end of a textile towel into a textile towel dispenser, such that the apparatus can be fitted to already existing towel dispensers as well as to newly manufactured towel dispensers.

Now in order to implement these and still further objects of the invention, which will become more readily apparent as the description proceeds, the method of the present development is manifested by the features that, the used length of the textile towel is retracted behind a cover by means of a weighted roller lying in a towel loop formed behind the cover prior to winding-up the used length of the textile towel onto a towel roll for used toweling.

A primary advantage of the inventive method resides in the simple technique which is employed for retracting the towel after each hand-drying operation as well as after the roll of clean toweling has been consumed. The towel loop, or, as the case may be, the end of the towel is pulled behind the cover which may be part of an enclosure, by means of the weighted roller which is substantially horizontally placed in the towel loop.

In a further development of the method according to the invention the textile towel is guided over at least one rotatably-supported retraction roller and the towel loop loaded with the weighted roller is located behind or after the retraction roller. This technique has the advantage of reducing the frictional drag on the towel.

When the towel dispenser is not in use, the weighted roller or roll draws the front portion of the towel loop tightly against the front and the bottom of the towel dispenser and the remainder of the towel loop disappears behind the cover.

When the towel is grasped and pulled, a length of clean toweling comes out of the dispenser as before, but also a sufficient length of the used towel moves up and out of an entrance opening of the cover, so that a free space is obtained between the towel loop and the towel dispenser readily enabling drying of the hands.

As soon as the textile towel is released, it is again drawn behind the cover. The damp, wrinkled and soiled towel region, resulting from the hand-drying operation, thus disappears behind the cover where it cannot be seen by a person looking at the towel dispenser.

In case that the towel loop is open, i.e. when the end of the roll of clean toweling is pulled out of the towel dispenser and then released, the weighted roller suspended behind the cover can fall without obstruction all the way do to the floor or bottom region of the cover and such descending weighted roller then pulls the end of the towel entirely behind the cover. The end of the towel thus is not visible and can no longer be used.

In the inventive method as described hereinbefore the towel is continually placed under tension while the user's hands are being dried due to the load of the weighted roller; this somewhat impairs, however, the drying convenience.

Therefore, according to a further particularly preferred development of the method apparatus the last-mentioned disadvantage is eliminated by the provision of a retracting apparatus operating with a time-delay and preventing the weighted roller from pulling back the length of towel which was drawn out from behind the cover back behind such cover for a few seconds. This has the effect of producing a loose loop of toweling each time the portion of the towel which flatly lies against the towel dispenser is pulled down. The loose towel loop thus formed is, however, automatically retracted after the user's hands have been dried.

As alluded to above, the invention is not only concerned with the aforementioned method aspects but also relates to a novel construction of apparatus for the performance thereof. Generally speaking, the inventive apparatus comprises means for retracting towel loops and an end of a textile or cloth towel into a towel dispenser.

To achieve the aforementioned measures the inventive apparatus for retracting towel loops and an end of a textile towel into a towel dispenser, in its more specific aspects, comprises:

- a first towel loop formed outside the cloth towel dispenser;
- a cover operatively associated with the cloth towel dispenser;
- a second towel loop formed by the cloth towel and disposed behind the cover;
- a weighted roller placed in the second towel loop;
- a retraction roller provided with friction means and guiding said second towel loop to the rear of said cover;
- a blocking device coupled with the retraction roller and containing a time delay mechanism determining a predetermined moment of time for retracting said first towel loop.

Due to the blocking device containing the time delay mechanism, the retraction of the first towel loop after it has been pulled out under the action of the weighted roller, is delayed until a predetermined moment of time.

In a preferred embodiment of the inventive towel dispenser apparatus the retraction roller has a journal and the blocking device comprises:

- a friction clutch including a friction wheel which is movably supported at said journal of said retraction roller, and
- further including means for engaging and disengaging said friction wheel to and from the journal of the retraction roller;
- a lever in the form of a sector of a large friction wheel and which lever cooperates with the friction wheel of the friction clutch and has a friction surface and engages the friction wheel by means of the friction surface;
- a stop disposed opposite to the lever;
- a housing;
- a first suction cup connected to the lever and a second suction cup connected to the housing, the first and second suction cups being operative as the time delay mechanism for the blocking device.

When the towel is pulled out from behind the cover of the inventive towel dispenser apparatus, the lever forming the sector of the large friction wheel is rotated into one end position in which it abuts the stop which limits its further rotary or angular motion. In this position such lever is held for several seconds by the pair of suction cups. The lever, acting under the influence of the forces tending to separate the suction cups and under the torque acting on the movably supported friction wheel and caused by the action of the weighted roller, is allowed to rotate back until it is no longer engaged with the movably supported friction wheel. In this position the lever remains in permanent contact with, but is not drivingly engaged with the movably supported friction wheel due to the action of a small torque.

In a further possible construction of the inventive apparatus the movably supported friction wheel constitutes a toothed wheel and the lever-shaped friction surface constitutes a lever having at least one tooth.

Advantageously, guides are provided at the inside of the cover on both side walls to vertically guide the weighted roller which is located inside the towel loop. One of the guides is attached to one of these side walls to additionally act as an obstructive ledge which extends into the vertical guide direction of the towel loop. This construction prevents the towel from being pulled out from the enclosure conjointly with the weighted roller. The obstructing ledges are provided so that an upward pull first displaces the towel loop and the weighted roller away from the vertical and then blocks the ends of the weighted roller. The towel and the weighted roller are thereby prevented from being pulled out from behind the cover.

According to a further advantageous development of the inventive apparatus at least one buffer, cushion or bumper is placed underneath the towel loop which contains the weighted roller in order to lessen the generation of undesirable noise and to prevent the cover from possibly being damaged.

A preferred construction of the inventive apparatus contains at least one opening which is contiguous to the bottom region or floor of the cover and provides a simple means for removing the weighted roller from behind the cover after the roll of clean toweling has been used up.

Advantageously, the retracting apparatus according to the invention is structured either for adaptation and attachment to an already existing towel dispenser or structured such as to be completely or at least partially installed on the inside of a newly manufactured towel dispenser behind the cover thereof. In this way it is possible to convert or retrofit existing towel dispensers in such a manner as to include the inventive towel retracting apparatus. Also, newly manufactured towel dispensers can be readily equipped with the inventive towel retracting apparatus.

The entire system according to the present invention for retracting towel loops and ends can be used to convert every existing towel dispenser, something which therefore is of great economic importance. The apparatus is relatively maintenance-free and requires no external source of energy, which implies that no special safety and installation problems associated with damp rooms are required to be solved.

There is actually very little extra work involved with the exchange of the towel rolls. This extra effort or work consists in merely taking out the weighted roller which lies on the bottom or floor of the cover, preferably through a special opening in the cover floor provided for this purpose, as already described, and placing the same back again behind the cover through the top thereof conjointly with a loop of the new towel.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIGS. 7 and 8 each show a vertical section through the blocking and delay mechanism illustrated in FIG. 6;

FIGS. 9 and 10 each show a diagrammatic illustration of the blocking and delay mechanism shown in FIG. 5;

DETAILED DESCRIPTION OF THE PREFERRED EMBODIMENTS

Figure 1:
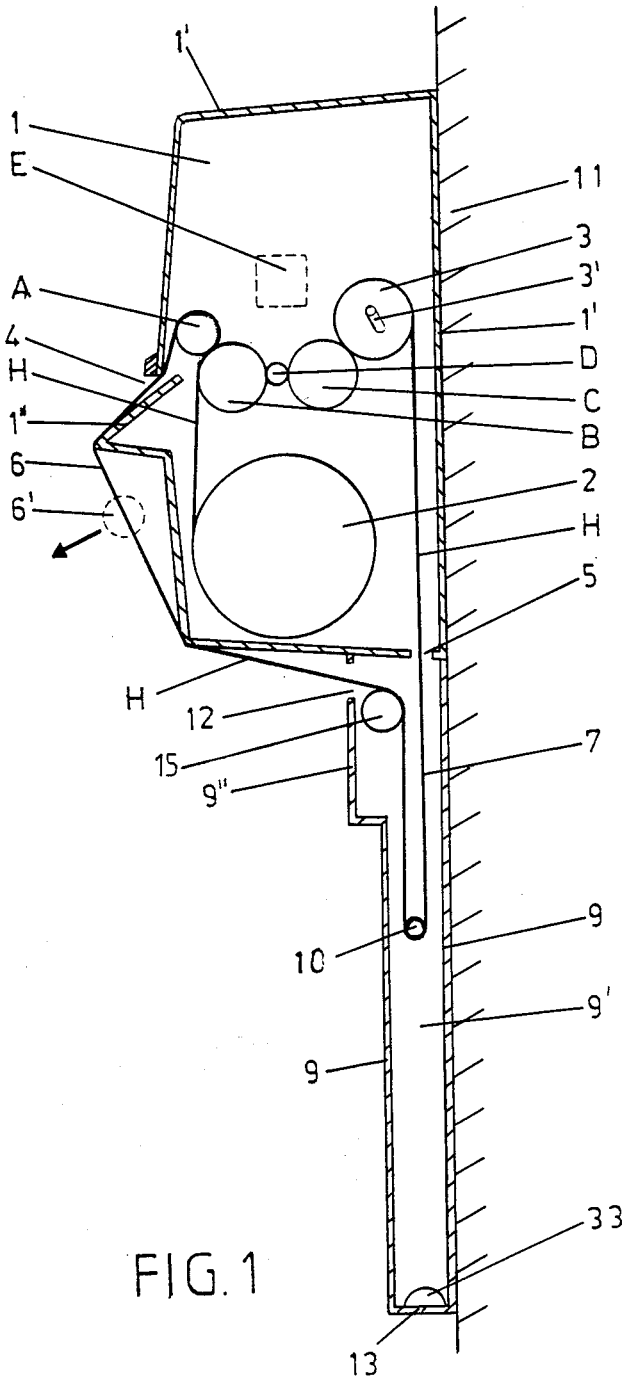
FIG. 1 shows a vertical section through a textile towel dispenser provided with a first embodiment of the towel retracting apparatus according to the invention.

Describing now the drawings, it is to be understood that only enough of the construction of the towel retracting apparatus in a textile or cloth towel dispenser, typically a hand towel dispenser, has been shown as needed for those skilled in the art to readily understand the underlying principles and concepts of the present development while simplifying the showing of the drawings. Turning attention now specifically to FIG. 1, there has been illustrated in section therein a towel dispenser 1 including a first embodiment of the towel retracting apparatus. A conventional textile towel dispenser 1 is provided with a cover 1′ which may form part of an enclosure. This cover 1′ is provided with a bulge or protuberance 1″ whose function is to produce sufficient space between a textile towel H and the cover 1′, so that the textile towel H can be grasped without wet hands necessarily touching the cover 1′. The textile towel H is guided from a towel supply roll 2 containing clean toweling to a towel roll or take-up roll 3 for used toweling through a slot or opening 4 for the exit of the clean toweling. The towel take-up roll 3 for the used toweling is supported under the cover 1′ by means of a bearing 3′. This bearing 3′ permits the axis of this dirty towel take-up roll 3 to shift as the diameter of this towel take-up roll 3 increases. A slit or opening 5 is provided underneath the cover 1′ of the towel dispenser 1 for the entry of the used toweling. A first loop of the towel H is located outside the towel dispenser 1 and is designated by the reference number 6. The location at which the towel H is pulled is symbolically indicated by the circle 6′ which is provided with an arrow to show the direction of pull. The reference character E designates a known stopping mechanism in the textile towel dispenser 1.

A second loop 7 of the towel H is located behind a further cover 9 which likewise may be part of an enclosure. A space 9′ behind the cover 9 is enlarged by an extension 9″. The textile towel H is threaded from the supply roll 2 between a guide roller A and a first roller B and then into the slot or opening 4. A second roller C is driven by the first roller B using a gear D. Therefore, when the guide roller A is turned by pulling at the first towel loop 6, the elements B, D and C transfer this rotational movement to the take-up roll 3 for the dirty or used toweling. At the lower part of the towel dispenser 1 in the region of the slit 5, there is fastened the cover 9 which is provided with an opening or slot 12. A weighted roller 10 is located in the second loop 7. Both the cover 1′ as well as the cover 9 are attached to a wall 11. The reference number 13 designates the bottom or floor of the cover 9 at which a buffer or cushion or bumper 33 is mounted and which is shown in a simplified manner in FIG. 1.

FIGS. 2 to 5 show different variations of the inventive towel retracting apparatus in different phases of operation. These figures are simplified and are shown on a reduced scale.

Figure 2:
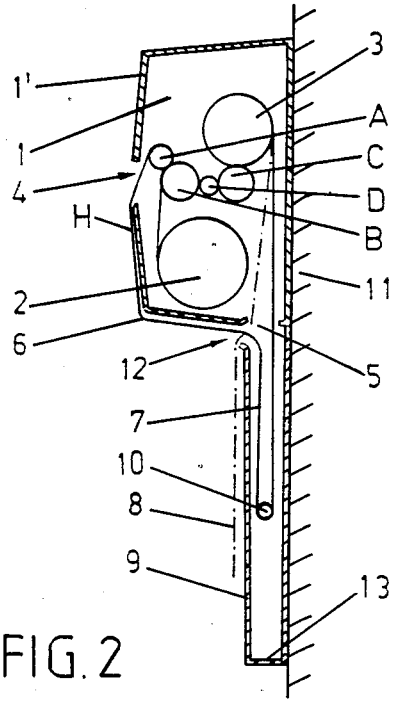
FIG. 2 shows the same vertical section as in FIG. 1 in a simplified illustration and on a reduced scale, wherein a dash-dotted line indicates the position of the hanging end of the roll of the used towel in a conventional textile or cloth towel dispenser.

FIG. 2 is essentially the same as FIG. 1, except that a dash-dotted line has been drawn in FIG. 2 to indicate the end 8 of the towel. The towel end 8 would normally freely hang down and out from the cover 1′ in the manner shown if it were not for the presence of the second loop 7 of the towel H and which loop 7 is pulled down by the herein described weighted roller or roll 10. The dash-dotted line, therefore, graphically illustrates the disadvantages of the state-of-the-art towel dispenser constructions.

Figure 3:
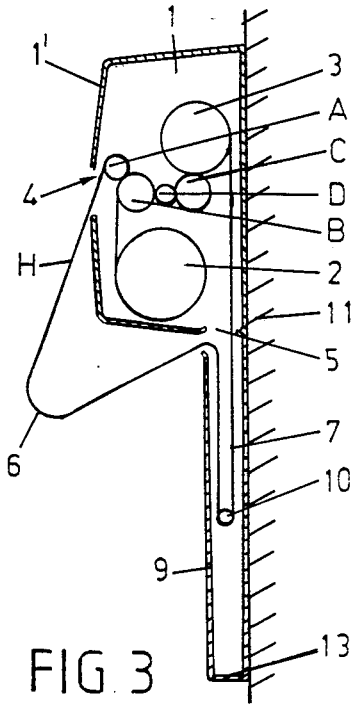
FIG. 3 shows the same vertical section as in FIG. 1 with the towel loop of the pulled-out towel.

When the first loop 6 of the towel H is pulled out of the towel dispenser 1 as shown in FIG. 3, a length of clean toweling is pulled out from such towel dispenser 1 and a length of used toweling is pulled out from the opening 12. As a result the advance mechanism in the textile towel dispenser 1 is activated, on the one hand, and the weighted roller 10 behind the cover 9 is lifted up, on the other hand.

When the textile towel H is released, the weighted roller or roll 10 drops back and the towel H is pulled towards the dispenser 1 in such a way that the towel portion or section at which the hands were dried comes to rest on the underside of the dispenser 1.

If, instead of releasing the first loop 6 of the towel H, the end 8 of the towel H, obtained when the supply roll 2 of clean toweling is consumed, is released, then the weighted roller 10 drops to the bottom or floor 13 of the cover 9 and thereby completely pulls the end 8 of the towel H behind the cover 9.

Figure 4:
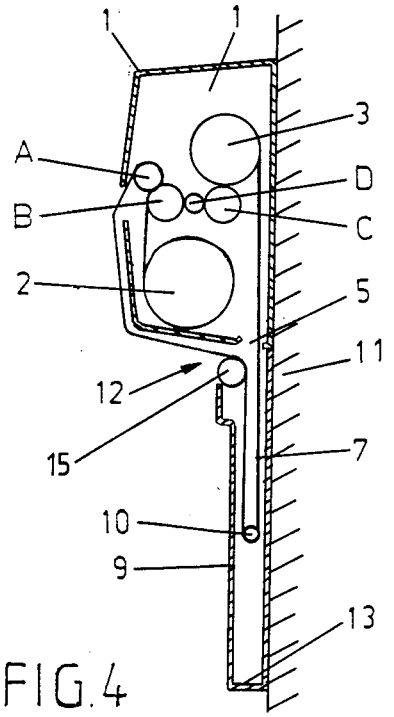
FIG. 4 shows a vertical section through a towel dispenser provided with a second embodiment of the towel retracting apparatus according to the invention including a retraction roller.

FIG. 4 shows a second embodiment of the inventive towel retracting apparatus attached to the textile or cloth towel dispenser 1 and containing a retraction roller 15 whose purpose is to reduce the friction between the towel H and the opening 12 in the cover 9.

Figure 5:
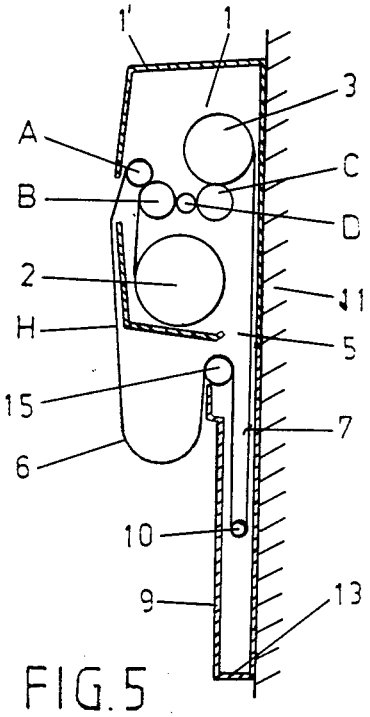
FIG. 5 shows a vertical section through a towel dispenser provided with a third embodiment of the towel retracting apparatus including a blocking and delay mechanism.

FIG. 5 shows a third embodiment of the inventive towel retracting apparatus having a blocking and delay mechanism which will be described further hereinbelow in greater detail. During the operating phase illustrated in FIG. 5, the retraction roller 15 is blocked, preventing the textile towel H from being retracted behind the cover 9 for a predetermined period of time. A loose first towel loop 6 is thus formed which is convenient to use.

In contrast to the towel retracting apparatuses shown in FIGS. 2 to 4, the first towel loop 6 which is pulled out in the presently described embodiment remains stationary or in place for a few seconds.

The weighted roller 10 is prevented from pulling the towel loop 6 behind the cover 9 by the blocked retraction roller 15.

The mechanical means accomplishing this effect is located in the region of the retraction roller 15 and is illustrated in detail in FIGS. 6 to 10 now to be described.

Figure 6:
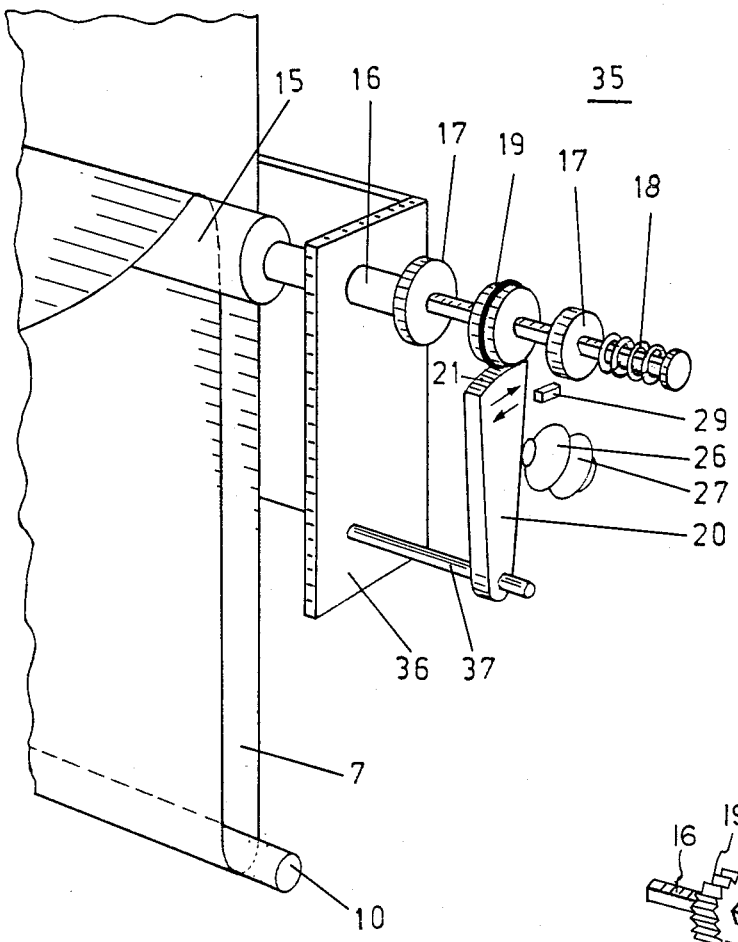
FIG. 6 is a schematic perspective view showing the most important elements of the blocking and delay mechanism in the towel retracting apparatus shown in FIG. 5.

FIG. 6 shows a fragmentary schematic perspective view of the more important elements of a blocking and delay mechanism 35.

The textile towel H is wound or trained around at least one-fourth of the circumference of the retraction roller or roll 15 which is covered, for instance, with emery cloth. These two factors ensure that the towel H makes sufficient contact with the retraction roller 15, so that the necessary force can be transmitted to operate the blocking and delay mechanism 35.

A friction wheel 19 is connected to the retraction roller 15 by means of a slipping or friction clutch 17, 18, 19 via a journal 16 of the retraction roller 15. The slipping or friction clutch 17, 18, 19, as illustrated in this embodiment, comprises two friction flanges 17 and at least one friction clutch spring 18 in order to press these flanges 17 into contact with the friction wheel 19.

The slipping or friction clutch 17, 18, 19 is shown in FIG. 6 in its separated condition in order to simplify the illustration of the drawings. During operation the friction flanges 17 press at both sides against the end surfaces or faces of the friction wheel 19. The friction flanges 17 are displaceably arranged upon the parts of the journal 16 which are structured to possess a square profile or cross-sectional configuration and such friction flanges 17 are exposed to the pressure of the friction clutch springs 18. Again for purposes of simplifying the showing of the drawings there has only been depicted the right-hand friction clutch spring 18, the comparable left-hand friction clutch spring not being visible because it is partially located within the hollow space of the circular part of the journal 16 and also is partially covered by the left-hand depicted friction flange 17. The friction wheel 19 is mounted to be rotatable upon a circular part of the journal 16. As already explained, the friction wheel 19, similar to a three-part friction clutch, is rotated at both faces by the friction flanges 17 until the friction wheel 19 comes to standstill, as such will be described more fully hereinafter in conjunction with the showing of FIGS. 7 to 10. The slipping or friction clutch 17, 18, 19 is adjusted such that the weighted roller 10 can be raised and lowered while the friction wheel 19 rotates. The journal 16 and a pivot pin 37 extending from a sector-like lever 20 are held at a support plate 36.

The friction wheel 19 engages the lever 20. These engaging members are illustrated in FIGS. 9 and 10 by diagrammatic or schematically illustrated elements and in FIGS. 7 and 8 by more practical or more realistically shown constructional elements. FIGS. 7 and 9 show one end position and FIGS. 8 and 10 show the other end position of the lever 20 which moves back and forth between these two end or terminal positions.

In FIG. 7 the friction surface of the lever 20 is designated by the reference number 21. This friction surface 21 ends at a location 22. The center of mass 23 of the lever 20, indicated in FIGS. 9 and 10, illustrates that the lever 20 is pulled to the right due to its own weight G.

The lever 20 as shown in FIGS. 9 and 10 constitutes a sector of a large friction wheel. In the rest position shown in FIGS. 7 and 9 the lever 20 is not drivingly engaged with the friction wheel 19, but rather leans or bears at the location or one end 22 of its friction surface 21 against a friction surface 24 of the friction wheel 19, due to its appropriately arranged center of mass 23.

This has the effect that the friction wheel 19 rolls without resistance along the lever 20 and its friction surface 21 when it rotates in the direction indicated by the arrow 25, i.e. when the towel H is pulled down behind the cover 9 by the weighted roller or roll 10. However, when the towel H is pulled out of the opening 12 in the cover 9, i.e. when the friction wheel 19 rotates in the direction indicated by the arrow 25' (FIGS. 8 and 10), the lever 20 is gripped at its friction surface 21 and rotated from its rest position shown in FIGS. 7 and 9 to the position shown in FIGS. 8 and 10 which is determined or bounded by a lever stop or abutment 29. As a result the lever 20 presses a first suction cup 26 thereof against a second suction cup 27 which is attached to a housing 28.

The distance that the textile towel H has to move in order to bring the lever 20 into the just described position is relatively short. When more of the toweling is drawn out through the opening 12 of the cover 9 than is necessary to activate the lever 20, the friction clutch begins to slip. This implies that the retraction roller 15 continues to rotate, but that the friction wheel 19 remains stationary. The friction wheel 19 still tries to turn the lever 20 because, as illustrated in FIGS. 8 and 10, it is still engaged therewith. However, the lever 20 remains in the position in which it is pressed against the stop 29.

Now, when the towel H, which has been pulled out from behind the cover 9, is released, the weighted roller 10 begins to act on the lever 20 via the torque applied by the toweling wrapped on the retraction roller 15, which torque is transmitted to the friction wheel 19 over the now fully engaged friction clutch 17, 18, 19. This torque or force tends to return the lever 20 to its rest position. It can do this, however, only after the suction cups 26 and 27 have separated as a result of air leaking in between them.

This means that the lever 20 frees the blocked retraction roller 15 and thereby enables the towel H to be retracted only after the suction cups 26 and 27 have separated.

When the suction cups 26 and 27 are provided with a known, regulatable air supply valve, there can be regulated the time span during which the first towel loop 6 should be stationary.

Figure 6A:
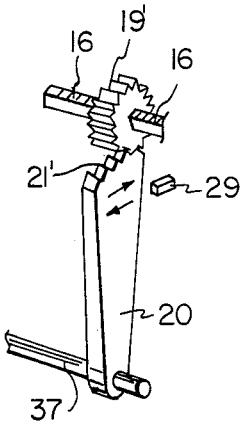
FIG. 6*a* illustrates a detail of a modification of the arrangement of FIG. 6.

The friction wheel 19 and the lever 20 could also be replaced by a toothed wheel 19' and a segment of a toothed lever 21' as shown in FIG. 6A.

Figure 11:
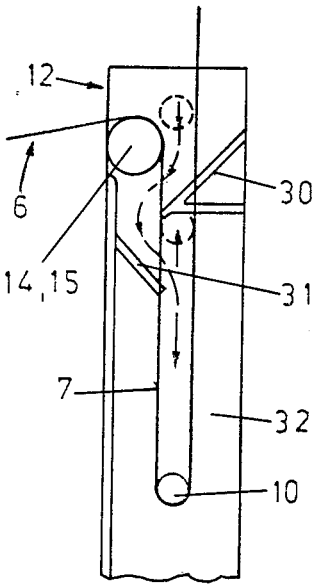
FIG. 11 shows a vertical section through a towel dispenser provided with a fourth embodiment of the towel retracting apparatus including means to prevent the weighted roller from being pulled out from behind the cover.
Figure 12:
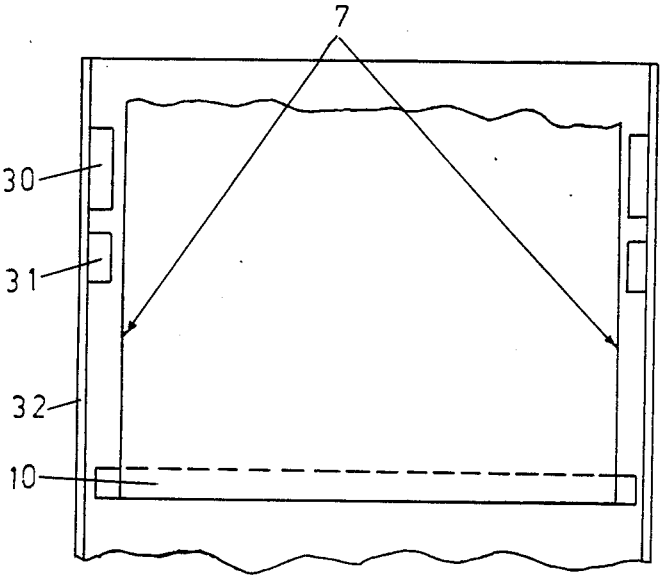
FIG. 12 is a view depicting the means for securing the weighted roller behind the cover shown in FIG. 11.

FIGS. 11 and 12 illustrate a fourth embodiment of the inventive towel retracting apparatus including means which prevent the weighted roller 10, originally placed behind the cover 9 through the opening 12, from being drawn out from behind the cover 9 by excessive pulling at the first towel loop 6.

Such means comprise guides 30 and 31 which are mounted at the inner side of each of two side walls 32 of the cover 9 immediately below the opening 12 of the cover 9 and the retraction roller 15.

The guides 30, 31 are dimensioned such that the second towel loop 7 can unobstructedly slip past these guides, but that the somewhat wider weighted roller 10 is caught thereby.

When the weighted roller 10 enclosed in the second towel loop 7 is introduced behind the cover 9 through the opening 12, the weighted roller 10 is first forwardly forced by the guides 30 and then back again towards the center of the shaft-like space by the other guides 31. The textile towel H unobstructedly passes the guides 30 and 31.

Now when a pulling action is exerted at the first towel loop 6, the weighted roller 10 is raised vertically upwardly, during which movement it is caught by the guides 30 which block any further attempt to pull out the towel H.

Figure 13:
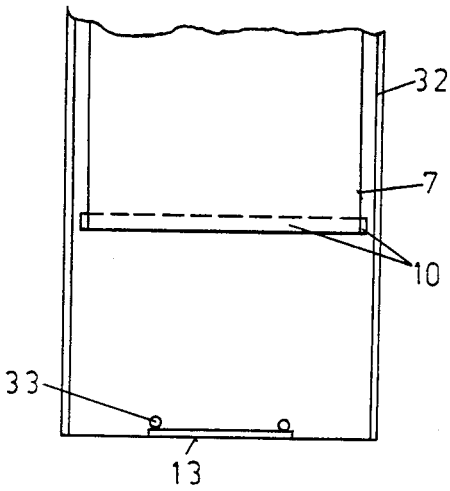
FIG. 13 is a front view of the lower part of the towel loop containing the weighted roller.
Figure 14:
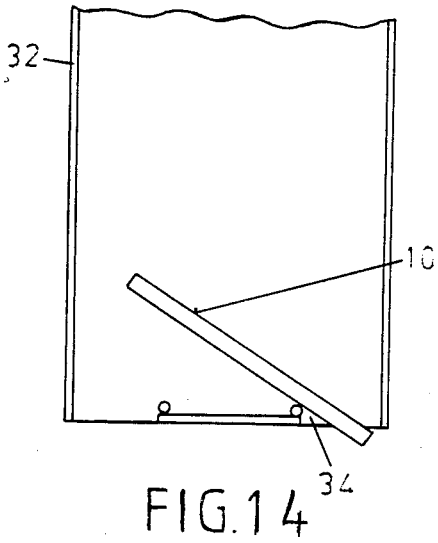
FIG. 14 is a front view of the inside of the cover which may form part of an enclosure and during such time when the weighted roller is being taken out.

FIGS. 13 and 14 illustrate an opening 34 in the bottom or floor 13 of the cover 9 which is provided for taking out the weighted roller 10.

FIG. 13 shows a front view of the lower part of the second towel loop 7 with the weighted roller 10. When the weighted roller 10 pulls in the towel end 8, it falls onto the buffer or cushion or bumper 33 located above the bottom or floor 13 of the cover 9.

When changing the hand towel roll, the towel end 8 (see FIG. 2) which is located in the concealed space or compartment 9' is pulled into the dispenser 1 and from there wound up onto the used toweling or take-up roll 3. The weighted roller 10 is then grasped through the opening 34, pulled at an oblique angle and taken out as illustrated in FIG. 14.

The towel retracting apparatus according to the present invention can be easily integrated into sanitary installations. For example a whole washing unit can be outfitted in a most aesthetic way with a wash basin, a soap dispenser, and a textile towel dispenser 1 including the towel retracting apparatus according to the present invention described hereinbefore.

The cover 9 for the second towel loop 7 containing the weighted roller 10 can be realized in a most simple manner, as previously illustrated, by a chute or shaft or chute-like or shaft-like construction.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for retracting towel loops and an end of a cloth towel into a cloth towel dispenser, comprising:

a first towel loop formed outside the cloth towel dispenser;

a cover operatively associated with said cloth towel dispenser;

a second towel loop formed by said cloth towel and disposed behind said cover;

a weighted roller placed in said second towel loop;

a retraction roller provided with friction means;

said retraction roller guiding said second towel loop to the rear of said cover;

a blocking device coupled with said retraction roller;

said blocking device containing a time delay mechanism determining a predetermined moment of time for retracting said first towel loop;

said retraction roller has a journal; and said blocking device comprising:

a friction clutch including a friction wheel movably supported at said journal of said retraction roller;

said friction clutch including means for connecting said friction wheel with said journal of said retraction roller;

a lever in the form of a sector of a large friction wheel cooperating with said friction wheel of said friction clutch;

said lever having a friction surface and engaging said friction wheel by means of said friction surface;

a stop disposed opposite to said lever;

a housing;

a first suction cup connected to said lever and a second suction cup connected to said housing;

said first and said second suction cups being operative as said time delay mechanism for said blocking device; and means for taking-up the retracted towel loop.

2. The apparatus as defined in claim 1, wherein:

said friction wheel of said friction clutch constitutes a toothed wheel; and said lever having said friction surface being provided with at least one tooth engageable with said toothed wheel.

3. The apparatus as defined in claim 1, further including:

a cover provided with side walls;

said cover defining an inner side at which there are arranged said side walls;

said weighted roller being guided along said side walls of said cover in a predetermined direction of movement;

said side walls being provided at said inner side of said cover with guides for said weighted roller; and one of said guides constituting an obstructive ledge extending into said predetermined direction of movement of said weighted roller.

4. The apparatus as defined in claim 3 further including:

at least one cushion means for said weighted roller located underneath said weighted roller.

5. The apparatus as defined in claim 3, wherein:

said cover has a bottom member and an opening contiguous thereto in order to permit removal therethrough of said weighted roller.

6. The apparatus as defined in claim 1, further including:

a towel dispenser; and said retraction roller and said blocking device are structured for attachment to said towel dispenser.

7. The apparatus as defined in claim 1, further including:

a towel dispenser;

a cover; and said retraction roller and said blocking device being structured for at least partial installation behind said cover of said towel dispenser.

* * * * *